US006502818B1

(12) United States Patent
Nonaka et al.

(10) Patent No.: US 6,502,818 B1
(45) Date of Patent: Jan. 7, 2003

(54) SHEET FEEDING DEVICE AND IMAGE FORMING APPARATUS THEREWITH

(75) Inventors: Ken Nonaka, Hachioji (JP); Kunihiro Kawachi, Hachioji (JP); Kyoichi Mizuno, Hachioji (JP)

(73) Assignee: Konica Corporation (JP)

( * ) Notice: Subject to any disclaimer, the term of this patent is extended or adjusted under 35 U.S.C. 154(b) by 147 days.

(21) Appl. No.: 09/713,879

(22) Filed: Nov. 16, 2000

(30) Foreign Application Priority Data

Nov. 26, 1999 (JP) ..... 11-336037

(51) Int. Cl.[7] ..... B65H 7/02
(52) U.S. Cl. ..... 271/258.01; 271/245
(58) Field of Search ..... 271/245, 258.01, 271/265.01

(56) References Cited

U.S. PATENT DOCUMENTS 3,966,189 A * 6/1976 Taylor et al. ..... 271/167
5,106,073 A * 4/1992 Kawauchi et al. ..... 271/121
5,318,287 A * 6/1994 Okayama ..... 271/10.09
5,355,206 A * 10/1994 Maruyama et al. ..... 271/228
6,010,127 A * 1/2000 DiCesare et al. ..... 271/242
6,354,584 B1 * 3/2002 Suga et al. ..... 271/10.12
6,382,622 B1 * 5/2002 Takada et al. ..... 221/167

* cited by examiner

*Primary Examiner*—Christopher P. Ellis
*Assistant Examiner*—Richards Ridley
(74) *Attorney, Agent, or Firm*—Bierman, Muserlian and Lucas

(57) ABSTRACT

A sheet feeding device includes: a conveyance path along which a recording sheet is conveyed; a separation roller that separates a recording sheet and conveys it; a registration roller that stops temporarily a recording sheet separated and conveyed by the separation roller and further conveyed along the conveyance path, and conveys the recording sheet again toward the image forming position at the prescribed timing; a detector that is provided in the conveyance path between the separation roller and the registration roller, and detects the recording sheet; a recognizing device that recognizes fluctuation of conveyance timing of the recording sheet based on the results of the detection made by the detector; and a controller that conducts conveyance control for the recording sheet at the upstream side of the registration roller based on the results of the recognition made by the recognizing device.

20 Claims, 9 Drawing Sheets

FIG. 3 (a)
FIG. 3 (b)
FIG. 3 (c)
FIG. 3 (d)
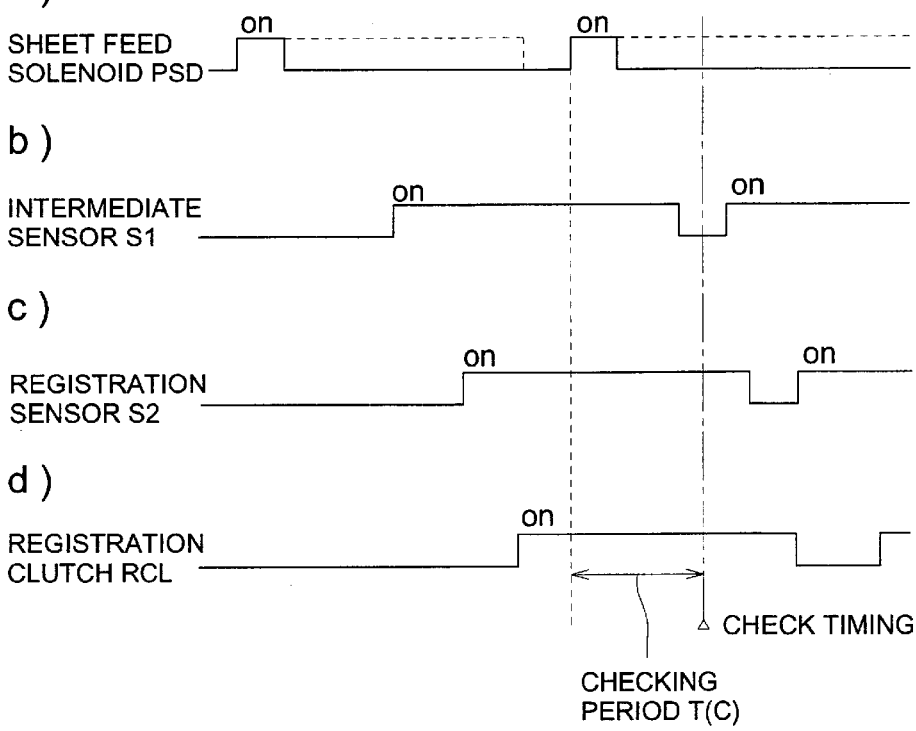
FIG. 4 (a) FIG. 4 (b) FIG. 4 (c)
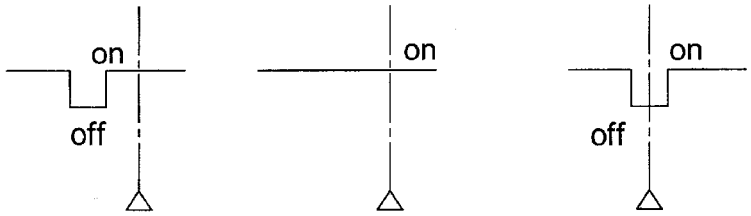

SHEET FEEDING DEVICE AND IMAGE FORMING APPARATUS THEREWITH

BACKGROUND OF THE INVENTION

The present invention relates to a sheet feeding device that conveys a transfer sheet for image forming, and to an image forming apparatus equipped with the sheet feeding device.

In an ordinary image forming apparatus, a transfer sheet stacked in a sheet feed cassette is fed out by a sheet feed roller, then, a separation roller separates a single transfer sheet which is conveyed to a registration roller along a sheet feed path. On the other hand, in the vicinity of a rotating image carrier, there are arranged a charging means, an image-wise exposure means and a developing means, and a photosensitive surface of the image carrier is electrically charged uniformly, and then is subjected to image-wise exposure, thus, there is formed a latent image that is developed to turn into a toner image. A registration roller that stops rotating and rotates for conveyance synchronizes with the toner image on the carrier to convey a transfer sheet, and thereby the toner image is transferred by a transfer means onto the transfer sheet in a transfer section. The transfer sheet onto which the toner image has been transferred is subjected to fixing in a fixing unit where the toner image is fixed, and then, is ejected out.

Even in the case of the image forming apparatus stated above, a high speed printer having high capacity for processing is requested. Conditions of the high speed printer are that (1) a peripheral speed of the rotating image carrier is high, and a conveyance speed for a transfer sheet is high and (2) intervals of conveyed and ejected transfer sheets are small. High speed printers satisfying the conditions of (1) and (2) are now studied actively.

When conducting continuous print, a registration roller repeats a cycle of rotation/stop/rotation, and in the course of rotation, there is conducted conveyance of a transfer sheet to a transfer area. When the registration roller is in the state of stop, it corresponds to the intervals of transfer sheets in the aforesaid condition (2). A leading edge of the succeeding transfer sheet needs to reach the position of the registration roller within the period of suspension of the registration roller, and if the leading edge of the succeeding transfer sheet reaches the position of the registration roller after the registration roller has started its rotation, the interval of the conveyed transfer sheet is made longer, resulting in fluctuation of sheet intervals and slippage of transferred toner images. These are caused by fluctuation of sheet feed timing.

As a technology to reduce fluctuations of sheet intervals in the past, there has been taken a method to provide a transfer sheet detection means in a sheet feed path, and thereby to detect the trailing edge of the preceding sheet and to conduct preliminary feeding of the succeeding sheet based on the detection mentioned above. In this case, when a jam occurs or a job is finished, the transfer sheet that has been fed preliminarily is suspended between a sheet feed tray and a main body. Therefore, a mechanism for returning the transfer sheet back to the sheet feed tray is needed.

Further, to secure sheet intervals for transfer sheets, a transfer sheet detection means is provided in a sheet feed path, and thereby, the trailing edge of the preceding transfer sheet is detected and sheet feed timing for the succeeding transfer sheet is changed for control. In this case, when sheet feed timing is delayed, it causes a fall of processing capacity, which is a drawback that the processing capacity is not constant.

SUMMARY OF THE INVENTION

For the purpose of setting the sheet intervals for transfer sheets, it is necessary to make fluctuation of sheet feeding timing small. Inventors of the invention paid attention to that the fluctuation of sheet feed timing was caused in a process including a sheet feed cassette up to sheet feeding and sheet separation, and have achieved a technology to reduce the fluctuation of sheet feed timing between a separation roller to a registration roller.

A first object of the invention is to provide a sheet feeding device in which the fluctuation of sheet feed timing is reduced in a sheet feed path up to a registration roller. A second object of the invention is to provide an image forming apparatus in which the sheet feeding device mentioned above is equipped and high speed printing is conducted.

The first object of the invention is attained by a sheet feeding device wherein a detection means that detects sheet running between a separation roller that separates a transfer sheet for conveyance and a registration roller that feeds a transfer sheet in synchronization with an image formed on an image carrier, and thereby, the detection means judges whether the state of conveyance of the transfer sheet conveyed through the separation roller is in a quick range or not, and sheet feed control at the upstream side of the registration roller is made based on the results of the judgment.

Further, the first object is attained by a sheet feeding device having the following structures: a conveyance path along which a recording sheet is conveyed; a separation roller that separates a recording sheet and conveys it; a registration roller that stops temporarily a recording sheet separated and conveyed by the separation roller and further conveyed along the conveyance path, and conveys the recording sheet again toward the image forming position at the prescribed timing; a detector that is provided in the conveyance path between the separation roller and the registration roller, and detects the recording sheet; a recognizing means that recognizes fluctuation of conveyance timing of the recording sheet based on the results of the detection made by the detector; and a control means that conducts conveyance control for the recording sheet at the upstream side of the registration roller based on the results of the recognition made by the recognizing means.

The second object of the invention is attained by an image forming apparatus forming a toner image on an image carrier and transferring the toner image onto a transfer sheet that is separated for conveyance by a separation roller and conveyed by a registration roller in synchronization, wherein, a detection means that detects sheet running is provided in a sheet feed path between the separation roller and the registration roller, and thereby, the detection means judges whether the state of conveyance of the transfer sheet conveyed through the separation roller is in a quick range or not, and sheet feed control at the upstream side of the registration roller is made based on the results of the judgment.

Further, the second object is attained by an image forming apparatus having the following structures: a sheet containing section that contains recording sheets; a sheet feed roller for feeding the recording sheet from the sheet containing section; a separation roller that separates the recording sheet fed by the sheet feed roller for conveyance; a conveyance path along which the recording sheet separated for conveyance by the separation roller is conveyed; a registration roller that stops temporarily a recording sheet conveyed along the conveyance path, and conveys the recording sheet again toward the image forming position at the prescribed timing; a detector that is provided in the conveyance path between the separation roller and the registration roller, and detects the recording sheet; a recognizing means that recognizes fluctuation of conveyance timing of the recording sheet based on the results of the detection made by the detector; and a control means that conducts conveyance control for the recording sheet at the upstream side of the registration roller based on the results of the recognition made by the recognizing means.

Each of FIGS. 3(*a*)–3(*d*) shows an example of a signal on a table of sheet feed control time.

Each of FIGS. 4(*a*)–4(*c*) is an illustration showing the state of input of the signal.

Figure 5:
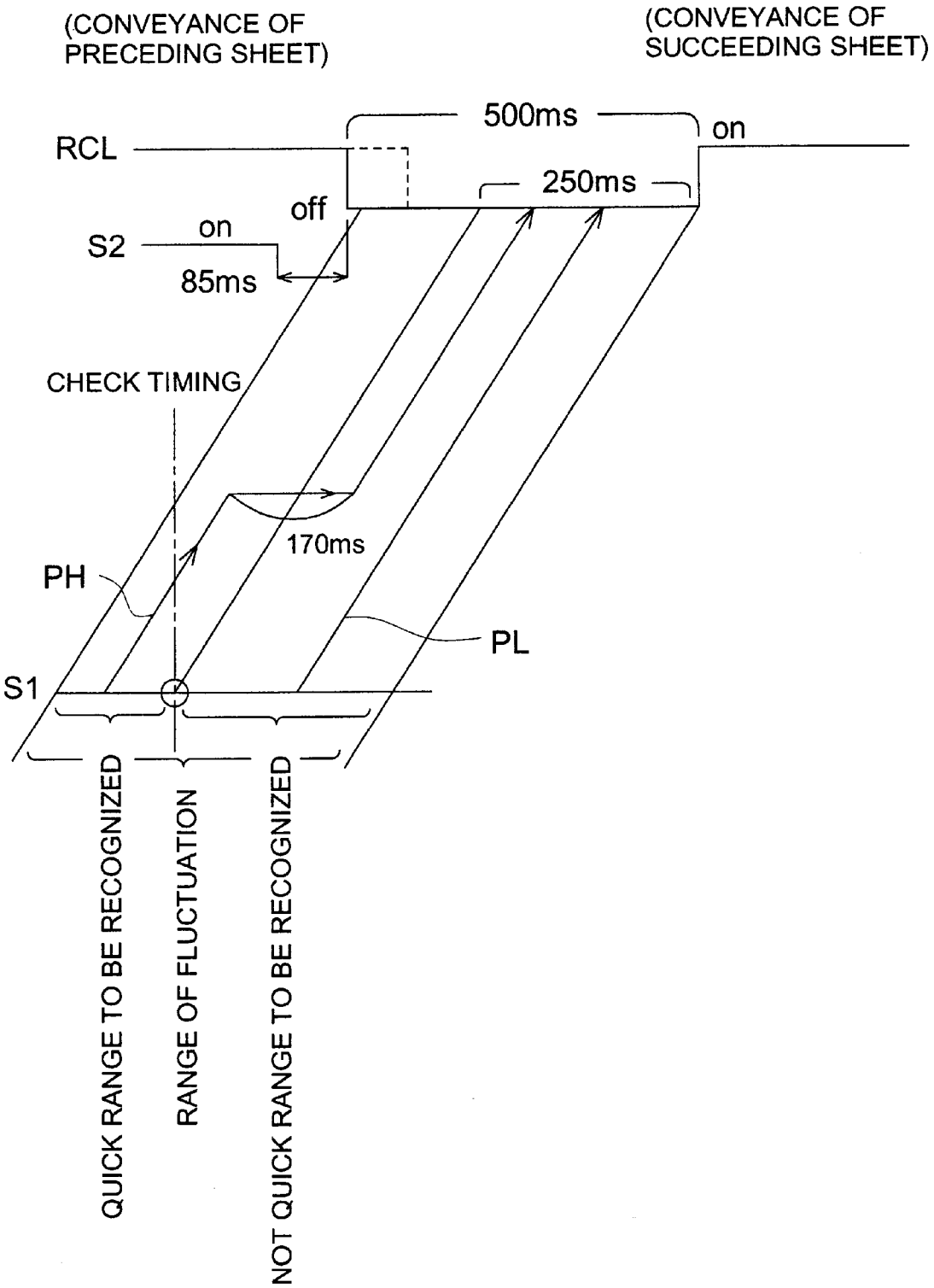

FIG. 5 is an illustration showing the state of sheet feeding of the invention.

Figure 6:
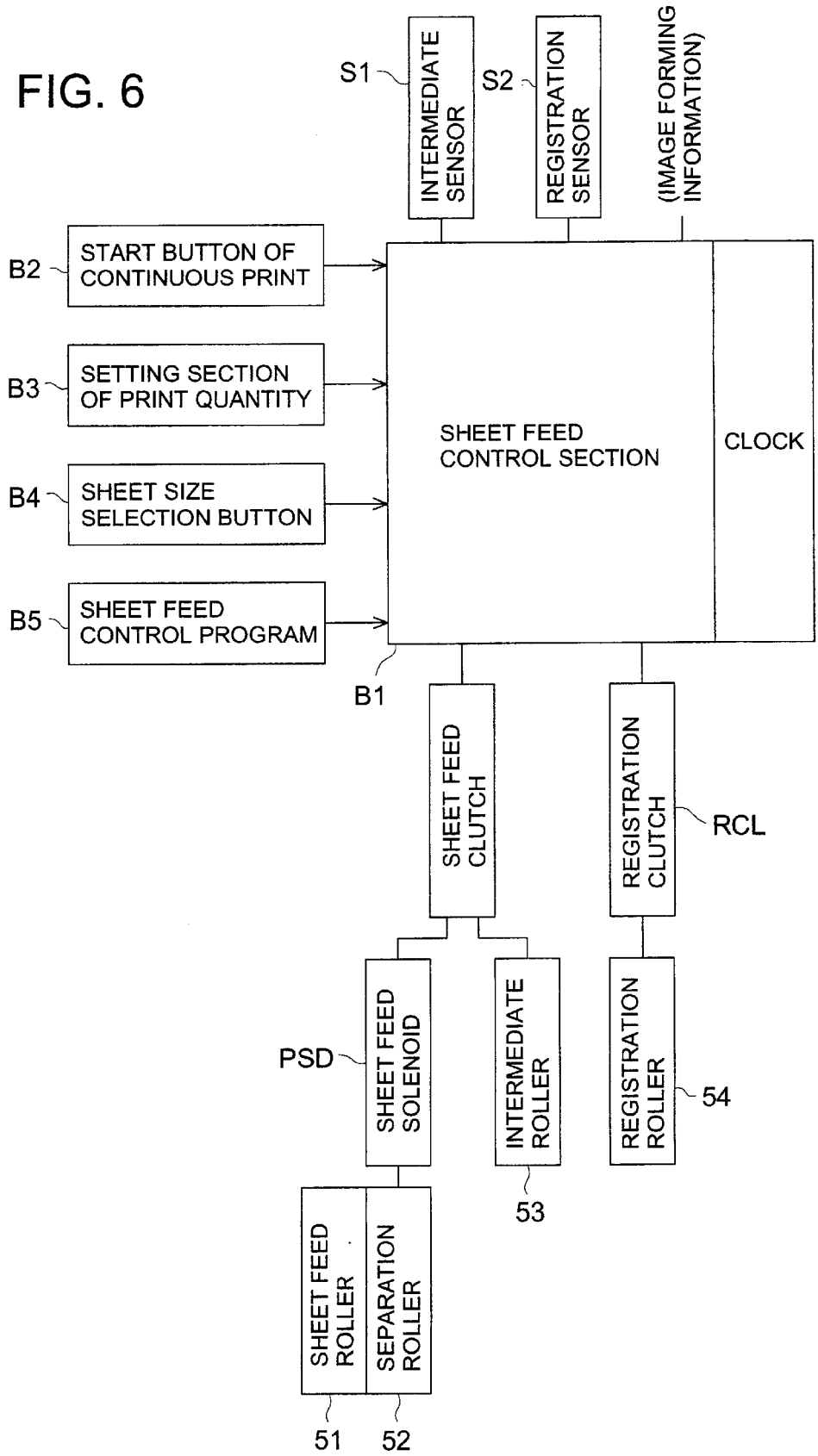

FIG. 6 is a block diagram for sheet feed control of the invention.

Figure 7:
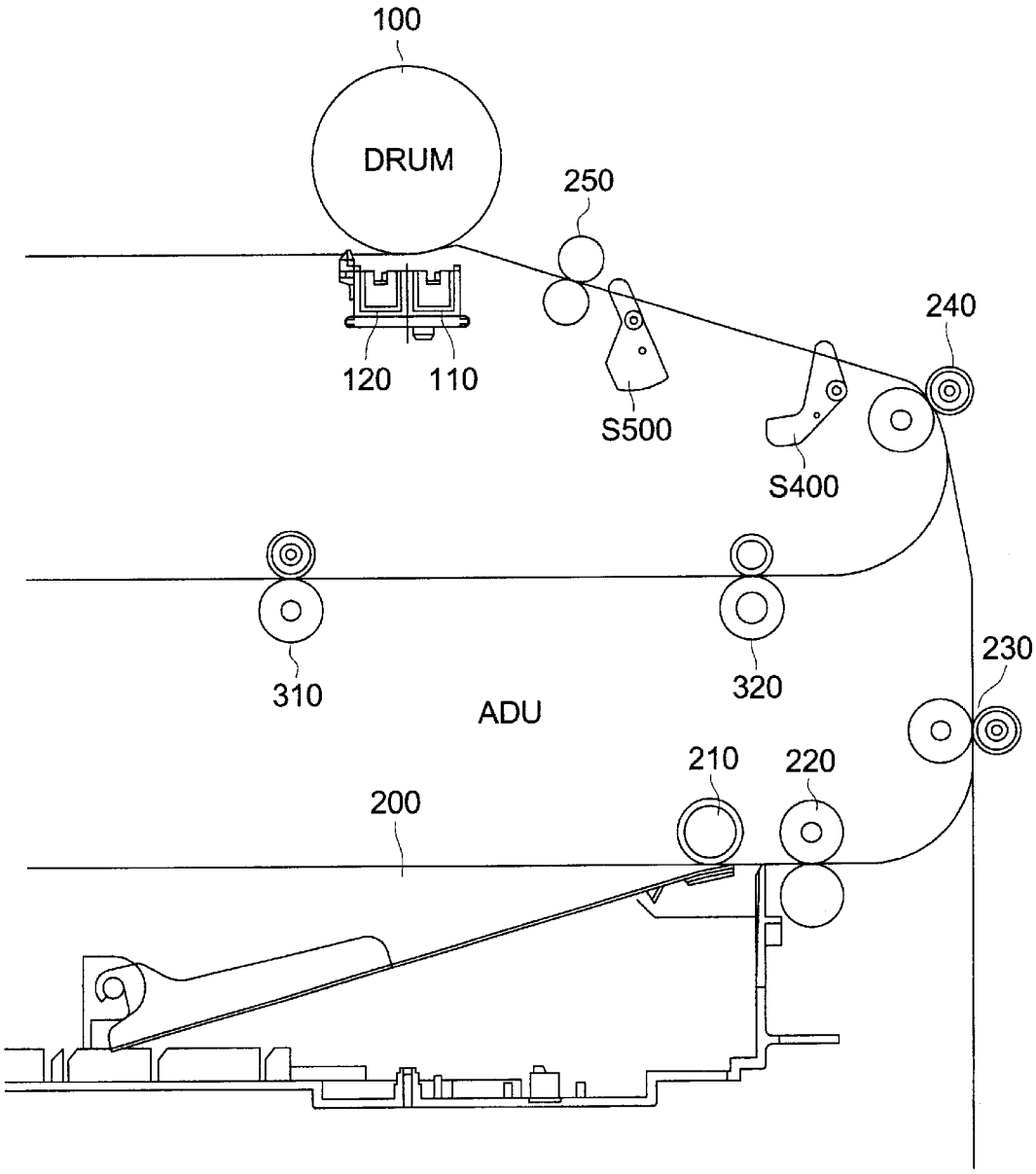

FIG. 7 is a partial sectional view for a sheet feed section extracted from the image forming apparatus.

Figure 8:
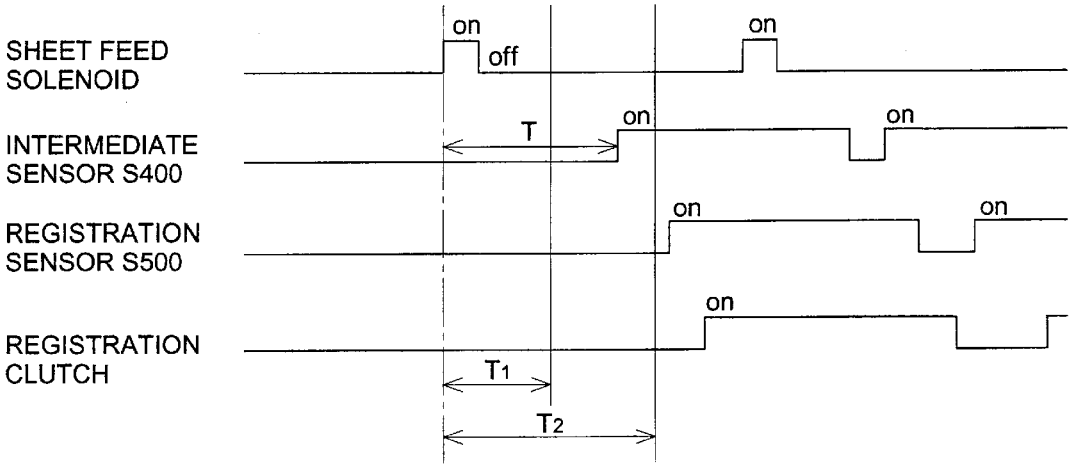

FIG. 8 is a diagram showing signal examples in a table of sheet feed control time in Example 2.

Figure 9:
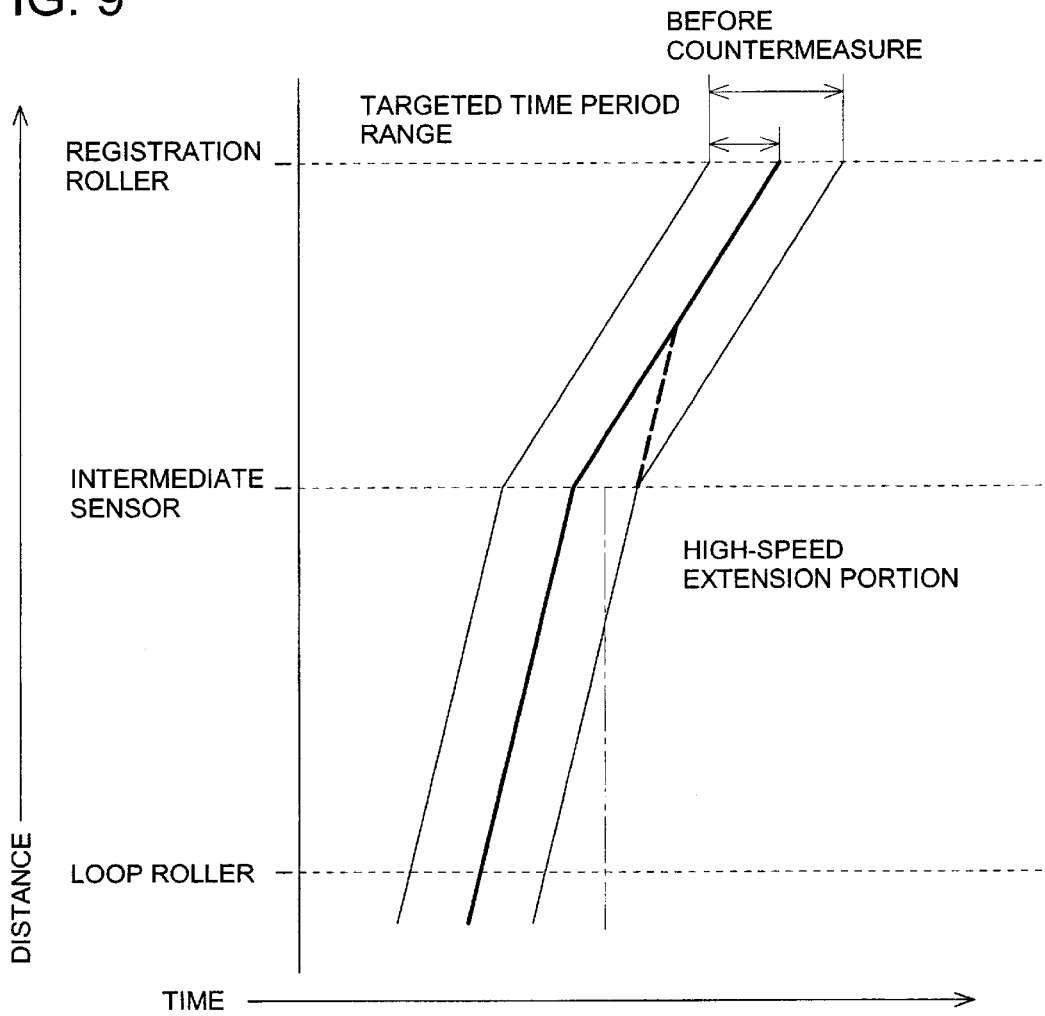

FIG. 9 is a diagram showing the state of sheet feeding in Example 2.

Figure 10:
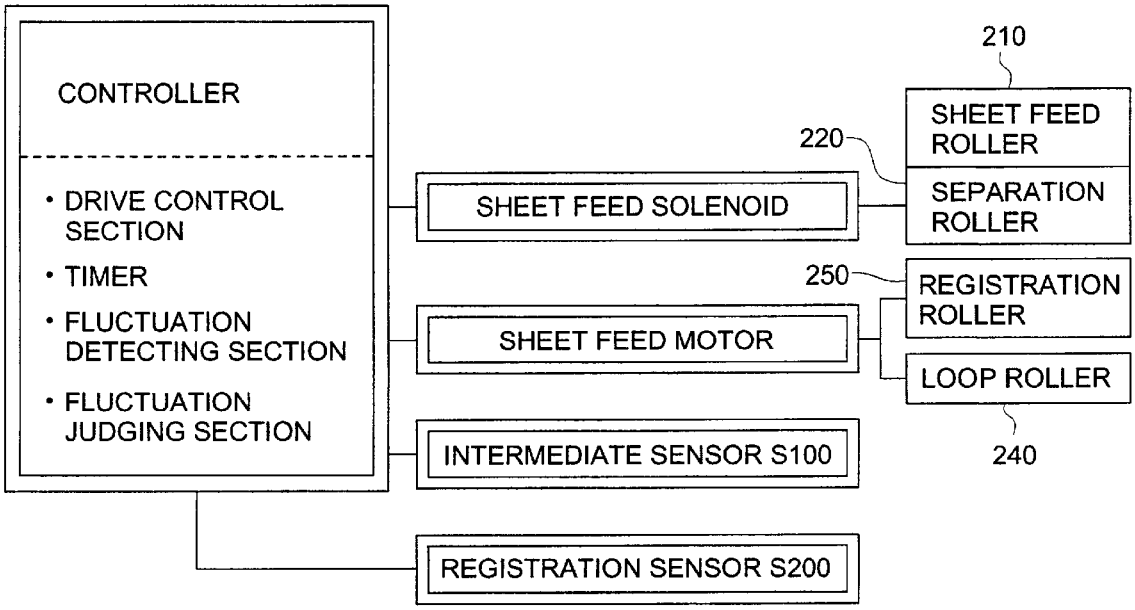

FIG. 10 is a block diagram of sheet feed control for realizing Example 2.

Figure 11:
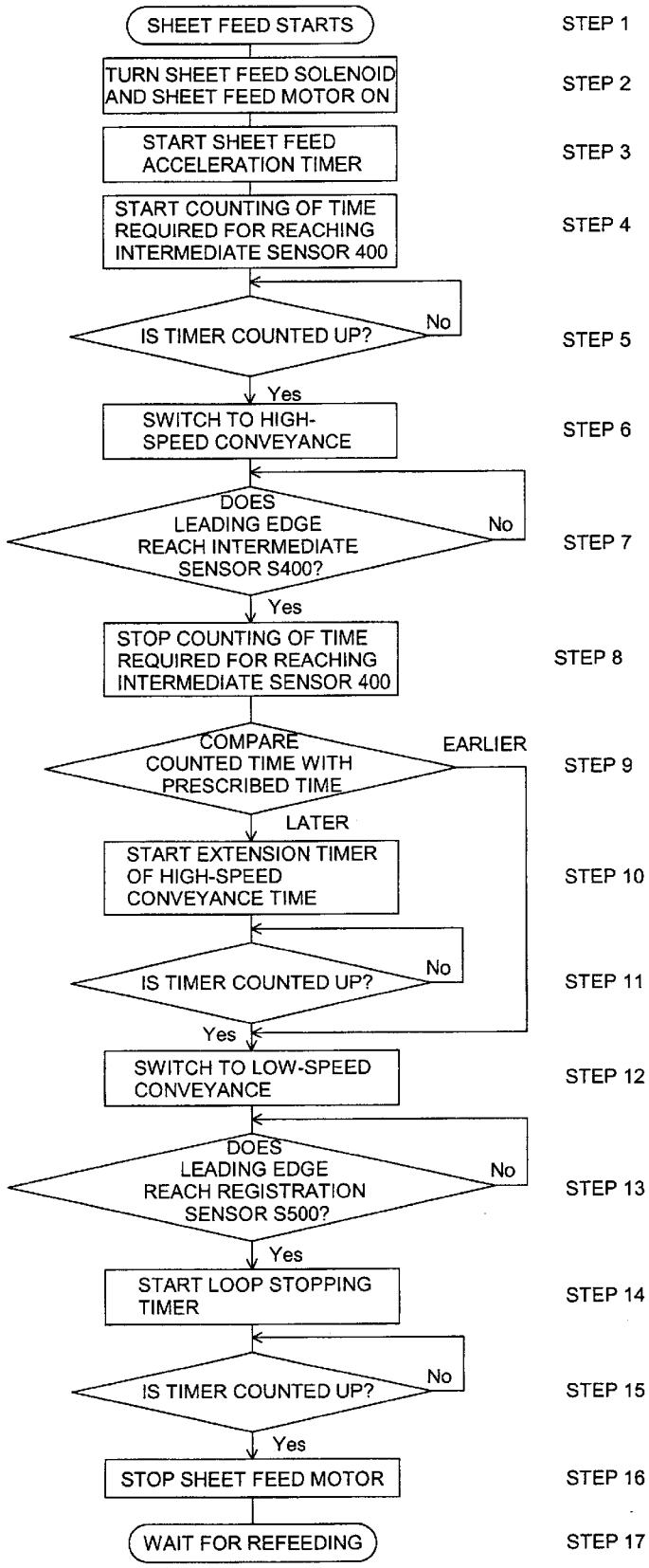

FIG. 11 is a flow diagram of Example 2.

DETAILED DESCRIPTION OF THE PREFERRED EMBODIMENT

Figure 1:
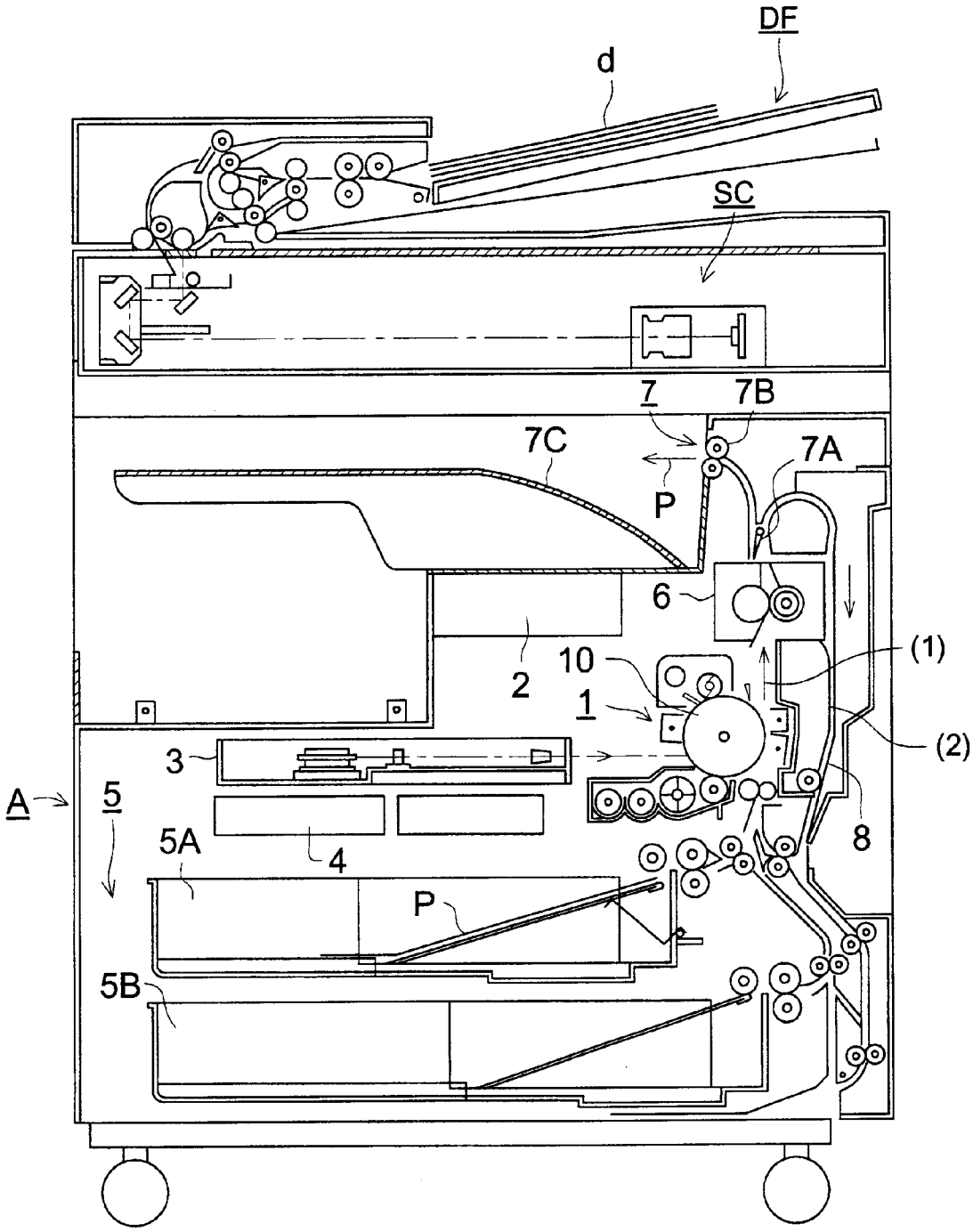
FIG. 1 is a general structural diagram of an image forming apparatus.
Figure 2:
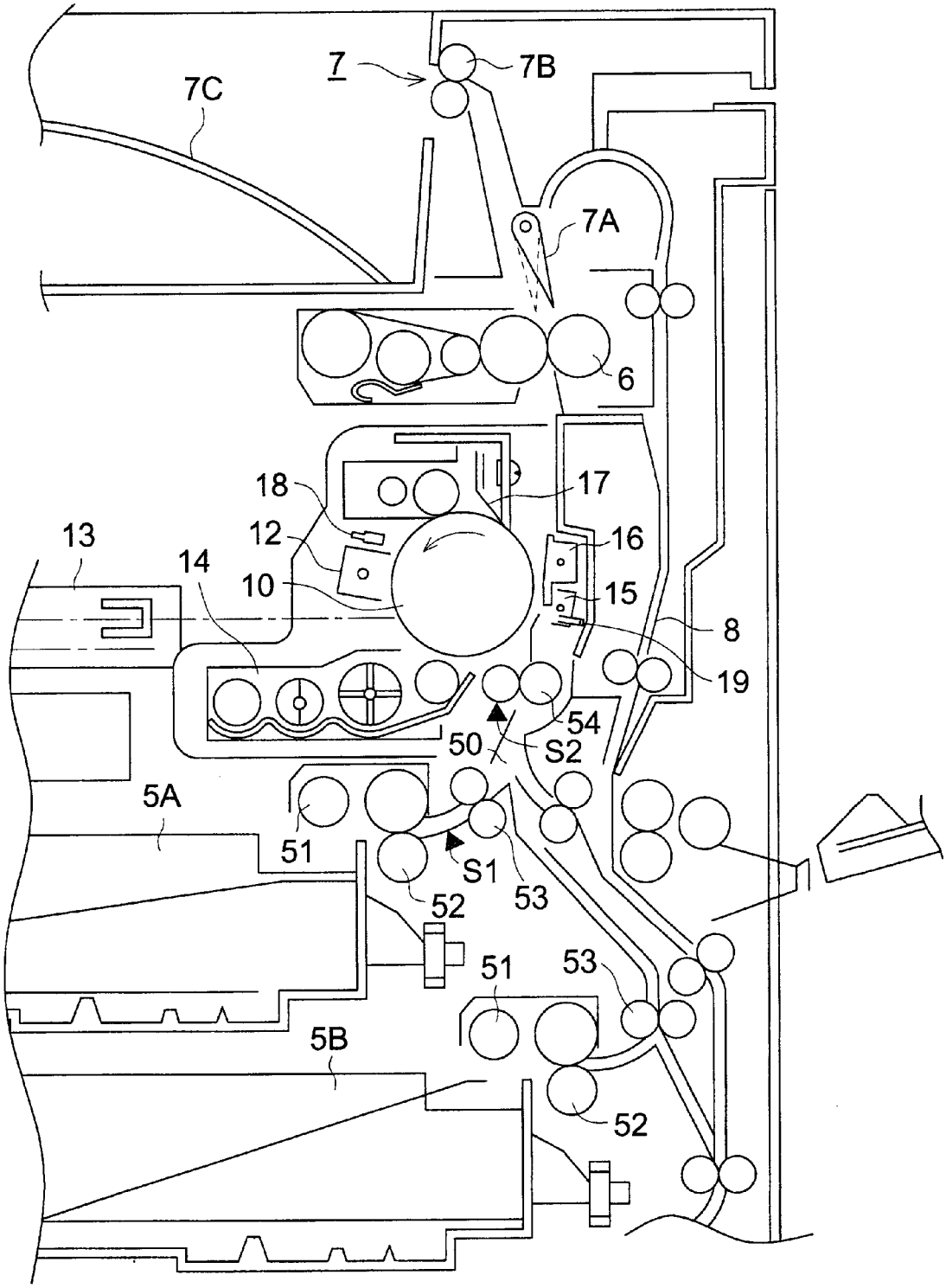
FIG. 2 is a partial sectional view including a sheet feeding section in FIG. 1.

First example of the invention will be explained as follows, referring to the drawings. FIG. 1 is a general structural diagram of an image forming apparatus, and FIG. 2 is a partial sectional view including a sheet feeding section in FIG. 1.

Illustrated image forming apparatus main body A is equipped with image forming section 1, image processing section 2, image writing section 3, high voltage power supply section 4, sheet feed conveyance section 5, fixing unit 6, sheet ejection section 7 and refeeding means (ADU) 8 for automatic two-side copying.

On top of the image forming apparatus main body A, there are mounted image reading unit SC and automatic document feeder DF. On the illustrated left upper portion of the image forming apparatus A on the sheet ejection section 7 side, sheet ejection tray 7C or an unillustrated sheet-finishing unit can be connected.

Each of documents "d" placed, with each first page facing upward, on a document platen of the automatic document feeder DF is separated one by one to be conveyed, and one side or both sides of the document are read by an optical system of the image reading unit SC to be read in CCD image sensor.

Analog signals converted photoelectrically by a CCD image sensor are subjected to analog processing, A/D conversion, shading correction and image compression processing in image processing section 2, and then, signals are sent to image writing section 3.

In the image writing section 3, image carrier 10 of image forming section 1 is irradiated by outputted light from a semiconductor laser, and a latent image is formed on the image carrier 10. In the image forming section 1, there are conducted charging, exposure, transfer, separation and cleaning, and an image is transferred onto transfer sheet P conveyed from sheet feed conveyance section 5. Transfer sheet P carrying thereon the image is subjected to fixing conducted by fixing unit 6, and is ejected from sheet ejection section 7 to sheet ejection tray 7C. Or, transfer sheet P whose one side has been finished in terms of image processing which is fed in the refeeding means 8 by sheet-ejection path switching plate 7A is subjected again to image processing for the other side thereof in the image forming section 1, and is ejected to sheet ejection tray 7C by sheet ejection roller 7B of the sheet ejection section 7.

On the right side of image forming apparatus main body A in FIG. 1, sheet feed cassettes 5A and 5B are provided to be lower than image forming section 1, and fixing unit 6 and sheet ejection section 7 are provided to be higher than the image forming section 1, both on the image forming apparatus main body A. Due to this vertical arrangement structure, there is formed sheet conveyance path (1) which is mostly vertical. Transfer sheet P fed out of the sheet feed cassette 5A or 5B is conveyed along this vertical sheet conveyance path (1), and is ejected out of the image forming apparatus main body A.

Sheet conveyance path (2) related to refeeding means 8 is formed to be almost in parallel with the vertical sheet conveyance path (1). Owing to the formation of the vertical sheet conveyance paths (1) and (2) stated above, there is formed a sheet conveyance path from sheet feed cassette 5A to sheet ejection section 7 which is shortest.

FIG. 2 is a partial sectional view including a sheet feeding section in FIG. 1.

In the drawing, the numeral 10 represents an image carrier which is a photoreceptor drum having thereon a photoconductive layer such as OPC and Se. The image carrier 10 is driven to rotate in the arrow direction. The numeral 12 is a corona charger which charges the surface of image carrier 10 uniformly, and 13 represents an image-wise exposure means which projects an optical image on the image carrier 10 and forms thereon an electrostatic latent image. The numeral 14 is a developing unit which develops the electrostatic latent image formed on the image carrier 10 to form a toner image. The numeral 54 represents a registration roller which feeds transfer sheet P fed out of sheet feed cassette 5A or 5B explained in detail later to the transfer position in synchronization with formation of an electrostatic latent image on image carrier 10. The numeral 15 represents a corona discharger for transfer use which transfers a toner image on image carrier 10 onto transfer sheet P, and 16 represents a corona discharger for separation use which separates the transfer sheet P after transferring from the surface of image carrier 10. The numeral 17 represents a separation claw to be in pressure contact with the surface of image carrier 10 which separates the transfer sheet P stuck on image carrier 10, 18 represents a pre-charging neutralizing means and 19 represents a simultaneous transfer/exposure means.

For continuous print, the registration roller 54 repeats its rotation and stop, and in the course of rotation, it conveys transfer sheet P toward a transfer area. The leading edge of transfer sheet P fed out of either sheet feed cassette 5A or sheet cassettes 5B selected arrives at the registration roller 54 while it is stopped, and then is conveyed toward in synchronization with a toner image on image carrier 10 after the registration roller 54 starts rotating.

Since each of sheet feed cassettes 5A and 5B arranged to form two steps vertically is equipped with the same separation conveyance means and the same operation is conducted, there will be explained sheet feeding from sheet feed cassette 5A hereafter. In the vicinity of a position of a leading edge of each of transfer sheets P stacked in sheet feed cassette 5A, there is positioned sheet feed roller 51 which is in contact with the top of transfer sheets P pushed upward from the lower portion in sheet feed cassette 5A. The uppermost transfer sheet P is fed out from the sheet feed cassette 5A by rotation of the sheet feed roller 51. The numeral 52 is a separation roller which is composed of upper roller that is controlled to rotate and stop in the conveyance direction and lower roller which is fixed. The transfer sheet P is separated and conveyed by the separation roller 52 one by one. The numeral 53 represents an intermediate roller, and the same driving source rotates or stops the sheet feed roller 51, the separation roller 52 and the intermediate roller 53 simultaneously.

With a background wherein it is unavoidable that fluctuations to a certain extent exist in the state of sheet feeding for transfer sheet P that is conveyed toward registration roller 54 through separation roller 52 along sheet feed path 50, the invention is to take a measure to reduce the fluctuations of sheet feeding caused in the section between the separation roller 52 to the registration roller 54, which will be explained in detail as follows.

Between the separation roller 52 and the registration roller 54, there is provided intermediate sensor S1 representing a detection means that detects passage of transfer sheet P along the sheet feed path 50. Further, registration sensor S2 that detects passage of the leading edge and the trailing edge of transfer sheet P is provided at a position that is extremely close to the registration roller 54. With regard to the intermediate sensor S1 and the registration sensor S2, when there already exist sensors provided along the sheet feed path 50 to detect sheet feeding and conveyance, the existing sensors can be used also as the sensors in the invention.

In the sheet feed control section of the invention, the state of conveyance of transfer sheet P is recognized by intermediate sensor S1 serving as a detection means that detects sheet running whether the state of conveyance of transfer sheet P is in a quick range or not, and when it is recognized to be in the quick range, a sheet feed clutch is turned off temporarily to suspend driving of sheet feed roller 51, separation roller 52 and intermediate roller 53 temporarily, and then, the sheet feed clutch is turned on again to drive the rollers mentioned above again and thereby to feed transfer sheet P again. While when the state of conveyance of transfer sheet P is recognized not to be in the quick range, sheet feeding is conducted as it is without controlling the sheet feed clutch in terms of turning on and turning off, and FIGS. 3(*a*)–3(*d*) show signal examples in a sheet feed control time table, in FIGS. 3(*a*)–3(*d*), sheet feed solenoid PSD is a solenoid provided on a driving source that drives sheet feed roller 51 and separation roller 52, and when the sheet feed solenoid PSD is turned on for a period of 100 ms, for example, a driving gear makes one turn and a single transfer sheet is fed out of sheet feed cassette 5A. Since the image forming apparatus of the invention is a high speed printer capable of making 30 prints per minute (30 ppm), an interval of 2s is used for feeding transfer sheet P. Intermediate sensor S1 recognizes the state of conveyance of transfer sheet P at check timing which will be explained later. The state of conveyance is recognized depending on how the signal of "off" (passage of the trailing edge of transfer sheet P) or "on" (passage of the leading edge of transfer sheet P) is inputted in check period T (C).

(1) End of "off"-"on"

This signal input shows the state that the second sheet which is following the first sheet has already arrived at intermediate sensor S1 (FIG. 4(*a*)).

(2) No Edge Detection

This signal input shows the state wherein neither "off" the first sheet nor "on" of the second sheet is detected, and the second sheet has arrived at intermediate sensor S1, because the second sheet passed through the fist sheet by a close shave and stayed within a width of detection by intermediate sensor S1 (FIG. 4(*b*)).

(3) Ending "off" and Waiting "on"

This signal input shows the state wherein the first sheet has passed intermediate sensor S1, but the second sheet has not arrived at it (FIG. 4(*c*)).

Signal examples shown in FIGS. 3(*a*)–3(*d*) indicate the state mentioned above.

Detection made by intermediate sensor S1 is either one of (1), (2) and (3), and in (1) and (2), the state of conveyance of transfer sheet P is recognized to be in the quick range, and when the conveyance is in the state of (1) and (2), the sheet is stopped temporarily for a prescribed period of time, and then is fed again. The state of conveyance in (3) is recognized not to be in the quick range, and when the sheet is in the state of conveyance of (3), sheet feeding is continued as it is.

When the processing stated above is conducted, fluctuations in sheet feeding of transfer sheet P is reduced, and this will be explained in detail referring to the illustration of the example shown in FIG. 5.

Though transfer sheet P is conveyed at a constant speed of 140 mm/sec, when a period of 85 msec elapses after the trailing edge of preceding transfer sheet P in conveyance has passed registration roller S2, registration clutch RCL is turned off under the recognition that the preceding transfer sheet P has been conveyed to the transfer area, and registration roller 54 stops after making some turns caused by inertia (shown with dotted lines of about 100 msec). After a lapse of 500 msec from the moment when registration clutch RCL is turned off, registration clutch RCL for conveyance of succeeding transfer sheet P is turned on. A period of time during which the registration clutch RCL is turned off is sometimes set to be constant independently of a size of a transfer sheet (the number of prints per time varies depending on the sheet size in this case, and more prints are made for sheets of a smaller size), or, a period of time during which the registration clutch RCL is turned off is changed depending on the sheet size, and in the present example, a shortest period of time during which the registration clutch RCL is turned off is set, for example, to 500 msec.

To realize high speed printing under the condition that toner images on image carrier 10 are transferred onto transfer sheet P without being shifted, it is necessary that the leading edge of the transfer sheet P which has passed intermediate sensor S1 arrives at registration roller 54 within a period of about 400 msec during which the registration roller 54 is stopped surely. Incidentally, the state of conveyance of transfer sheet P that is separated from sheet feed cassette 5A and conveyed varies depending on sheet quality of the transfer sheet and environmental conditions, and it has fluctuations of about 400 msec. When the transfer sheet is conveyed toward the registration roller 54 under the condition of that fluctuations, some of the transfer sheets P have the problem that their leading edges do not arrive at the registration roller 54 while it is stopped. In the present example, a range of fluctuations of 150 msec wherein the conveyance is conducted faster for a fluctuation range of about 400 msec is a range to be recognized as a quick range, and transfer sheet PH to be conveyed within a range of that fluctuations is stopped temporarily for 170 msec and then is fed again. Transfer sheet PL conveyed within a range of 250 msec that is recognized to be not quick is fed as it is at a sheet speed of 140 mm/sec. Due to the sheet feed control to set a transfer sheet stopped temporarily into a fluctuation range of transfer sheet P that is not stopped temporarily, fluctuations of about 400 msec of transfer sheet P that is conveyed out of separation roller 52 are reduced to those of 250 msec when the transfer sheet P arrives at registration roller 54.

Check timing for intermediate sensor S1 to recognize whether transfer sheet P is in the quick state of conveyance or in not quick state of conveyance is established to the time when the leading edge of transfer sheet P whose fluctuation is reduced to 250 msec surely arrives within the period of suspension of about 400 msec for registration roller 54. In the present example, time setting is conducted so that the leading edge of transfer sheet P arrives at registration roller 54 earlier by 250–400 msec than the moment when registration clutch RCL for conveyance of the succeeding transfer sheet is turned on, when transfer sheet P that passed through intermediate sensor S1 at the check timing is conveyed along sheet feed path 50 at the speed of 140 mm/sec. Due to this setting of the check timing, the leading edge of the transfer sheet P whose fluctuations are reduced to 250 msec arrives without fail within the period of suspension of the registration roller 54.

The foregoing is explanation of the sheet feed control for a transfer sheet separated from sheet feed cassette 5A to be conveyed. Sheet feed control for a transfer sheet separated from sheet feed cassette 5B to be conveyed is also conducted by providing intermediate sensor S1 in a sheet feed path from separation roller 52 for sheet feed cassette 5B to registration roller 54. In this case, when there is provided a sheet feed path which is used commonly as both a sheet feed path from sheet feed cassette 5A and a sheet feed path from sheet feed cassette 5B, it is possible to provide intermediate sensor S1 in the common sheet feed path and thereby to conduct sheet feed control even for both the sheet feed cassette 5A and the sheet feed cassette 5B by using the intermediate sensor S1 in common.

FIG. 6 is a block diagram for sheet feed control in a sheet feeding device of the present example. In the image forming apparatus in which the sheet feeding device of the present example is incorporated, sheet feed control section B1 is included in the control section that controls the image forming apparatus totally to conduct sheet feed control. When the number of continuous prints is inputted by print quantity setting section B3 employing a ten-key, and a sheet size is selected by sheet size selection button B4, the sheet feed control section B1 determines sheet feed cassette 5A or sheet feed cassette 5B for sheet feeding. When continuous print start button B2 is pressed, the sheet feed control section B1 follows sheet feed control program B5 for sheet feeding.

Sheet feeding is conducted from the selected sheet feed cassette 5A or 5B, and with regard to the first print, sheet feed solenoid PSD is turned on to rotate sheet feed roller 51, separation roller 52 and intermediate roller 53, and thereby, the transfer sheet P is fed out and conveyed, then, passes through intermediate sensor S1 and its leading edge arrives at registration sensor S2. Then, when "on" signals are inputted, the sheet feed control section B1 turns on registration clutch RCL to convey the first transfer sheet P toward a transfer area. When the transfer sheet P passes from the registration sensor S2 and "off" signals are inputted, the sheet feed control section B1 turns off the registration clutch RCL to stop registration roller 54.

After a certain period of time from the moment when sheet feed solenoid PSD for the first sheet is turned on (which is turned off after 100 ms), sheet feed solenoid PSD is turned on so that the second transfer sheet P is fed out and conveyed. From signal information of "on" and "off" of intermediate sensor S1 within check period T (C) at the check timing, the sheet feed control section B1 recognizes whether the state of conveyance of the second transfer sheet P is in the quick range or not, and when it is recognized to be in the quick range, temporary suspension (170 msec) is given and then refeeding is conducted, while when it is recognized to be in not quick range, the sheet feeding is continued as it is.

For the third sheet and thereafter, the same sheet feed control as that for the second sheet is conducted.

The second example will be explained as follows, referring to FIGS. 7–11. FIG. 7 is a partial sectional view for a sheet feed section extracted from the image forming apparatus. In the diagram, transfer sheet P contained in sheet feed cassette 200 is fed out by sheet feed roller 210, then, is separated by separation roller 220, and is transported to loop roller 240 representing an intermediate roller through conveyance roller 230. Each of these separation roller 220 and loop roller is constituted by a pair of rollers, similar to the first example. With regard to the transfer sheet P, its trailing edge side is fed in by the loop roller 240 while the leading edge of the transfer sheet P is in pressure contact with registration roller 250 whose rotation is in suspension, thus, a loop is formed between the registration roller 250 and the loop roller 240. After that, rotation of the registration roller 250 is started at the prescribed timing, and the transfer sheet P is fed into a transfer area formed by image carrier 100 and transfer unit 110. After an image is transferred onto the transfer sheet P in the transfer area, the transfer sheet P is peeled from the surface of the image carrier 100 by separating unit 120. When forming images on two sides of transfer sheet P, an image on one side of the transfer sheet P is fixed by a fixing unit, and then, the transfer sheet P is conveyed to ADU 300 constituted with ADU rollers 310 and 320 wherein the transfer sheet P is reversed in terms of its surface and reverse, and is conveyed again to the transfer area through the loop roller 240 and registration roller 250 so that an image is formed on the reverse side. In this case, S400 is an intermediate sensor which detects passage of transfer sheet P. Further, S500 is a registration sensor which detects passage of each of the leading edge and the trailing edge of transfer sheet P. Incidentally, these sensors can be replaced with sensors provided in advance for detection of sheet feed conveyance.

In the present example, it is normal that transfer sheet P is conveyed at high speed until it reaches intermediate sensor S400, and the conveyance speed is switched to the low speed immediately after the transfer sheet P reaches the intermediate sensor S400. By controlling in that way, high productivity is attained by conveying transfer sheet P at high speed, and damage of the leading edge of transfer sheet P is prevented by easing an impact that is caused when the leading edge of transfer sheet P hits a registration roller whose rotation is in suspension. In order to stabilize extent of loop, the loop is formed at a low speed. Then, before the transfer sheet P arrives at registration roller 250, intermediate sensor S400 detects the transfer sheet P, and it recognizes whether the state of conveyance of the transfer sheet P is in not quick range or not. When the transfer sheet P is detected within a prescribed allowable range of time, the state of conveyance of the transfer sheet P is recognized to be appropriate, and the conveyance speed is switched from the high speed to the low speed immediately after the recognition. On the other hand, when the transfer sheet P is detected later than the time in a prescribed allowable range, the state of conveyance of the transfer sheet P is recognized to be not quick, and the timing to switch the conveyance speed from the high speed to the low speed is made to be later than the normal timing.

FIG. 8 is a diagram showing signal examples in a table of sheet feed control time in Example 2. In FIG. 8, a sheet feed solenoid is a solenoid provided on a drive source which drives sheet feed roller 210 and separation roller 220. Transfer sheet P is fed out when the sheet feed solenoid is turned on, then, the transfer sheet P passes through conveyance roller 230 and loop roller 240, and the leading edge of the transfer sheet P is detected by intermediate sensor S400. When the leading edge of the transfer sheet P is detected within time width T in a prescribed allowable range ($T_1$), the state of conveyance for the transfer sheet P is recognized to be appropriate. On the other hand, when the time width T in a prescribed allowable range is exceeded for recognition ($T_2$), the state of conveyance for the transfer sheet P is recognized to be not quick. Further, the state of sheet feed in the second example will be explained by using an illustration in FIG. 9. Transfer sheet P fed out of sheet feed cassette 200 passes through conveyance roller 230 and arrives at loop roller 240. After arriving at the loop roller 240, When the transfer sheet P arrives at intermediate sensor 400 which is located at the downstream side of the loop roller 240 after arriving at the loop roller 240, the high conveyance speed up to that moment is usually switched to the low conveyance speed immediately. The wording "usually" in this case means that the leading edge of the transfer sheet P arrives at the intermediate sensor 400 within time width T in a prescribed allowable range. Namely, it means the case of $T_1$ in FIG. 8. When the leading edge of the transfer sheet P does not arrive within time width T in a prescribed allowable range, namely, in the case of $T_2$ in FIG. 8, the state of conveyance of transfer sheet P is recognized to be in not quick range, and the conveyance speed is switched to the low conveyance speed after a prescribed period of time elapses from the moment when the transfer sheet P arrives at intermediate sensor S400. The wording "prescribed period of time" in this case is a period of time calculated in a way that the period of time may make the transfer sheet P to overtake an advance position before registration roller 250 after arriving at intermediate sensor S400 when the conveyance speed is switched immediately to the low conveyance speed, and it is a period of time calculated to be in the desired time width to arrive registration roller 250. By controlling in this way, it is possible to correct to the appropriate-state of conveyance without raising the conveyance speed, when the conveyance speed for transfer sheet P is slow.

FIG. 10 is a block diagram of sheet feed control for realizing Example 2. In the second example, a sheet feed clutch is not provided, and drive control for a loop roller is conducted directly by controlling the drive of a sheet feed motor, which is different from the first example.

FIG. 11 is a flow diagram of Example 2. After sheet feed start signals are accepted in STEP 1, a sheet feed solenoid and a sheet feed motor are turned on in STEP 2 to start sheet feeding for transfer sheet P. Then, in STEP 3, a sheet feed acceleration timer is started, and in STEP 4, measurement of time for transfer sheet P to reach intermediate sensor S400 is started. When a timer is counted up in STEP 5, the conveyance speed for transfer sheet P is switched to the high speed in STEP 6. After that, when arrival of the leading edge of the transfer sheet P at intermediate sensor S400 is detected in STEP 7, measurement of time required for reaching sensor S400 is stopped in STEP 8, and the time required which has been measured actually is compared with the prescribed time within a prescribed allowable range in STEP 9. When the time required is longer than the prescribed time, the sequence advances to STEP 10 in which an extension timer for high-speed conveyance time is started. When the timer is counted up in STEP 11, the conveyance speed is lowered to the low speed in STEP 12. When the time required is shorter than the prescribed time in STEP 9, the sequence skips STEP 10 and STEP 11 and advances to STEP 12. In either case, the sequence advances to STEP 12 in which the conveyance speed is switched to the low speed, and the leading edge of transfer sheet P is waited to arrive at registration sensor S500 (STEP 13), and in STEP 14, a loop stopping timer is started. When the timer is counted up in STEP 15, driving of a sheet feed motor is stopped in STEP 16, and the transfer sheet P stands by its refeeding in synchronization with transfer timing under the situation wherein a loop of transfer sheet P is formed between registration roller 250 and loop roller 240 (STEP 17). Then, driving for the refeeding is started in synchronization with refeeding signals, and thereby, images formed on an image carrier are transferred onto transfer sheet P. Further thereafter, the transferred images are fixed and are ejected out of the image forming apparatus.

In the invention, fluctuations in conveyance of transfer sheets before transferring are reduced and thereby sheet intervals in continuous print can be established to be narrow, which makes it possible to provide a sheet feeding device that is fitted to high speed processing and an image forming apparatus capable of printing at high speed.

What is claimed is:

1. A sheet feeding device comprising:

(a) a conveyance path along which a recording sheet is conveyed;

(b) a separation roller for separating and conveying the recording sheet;

(c) a registration roller for stopping temporarily the recording sheet separated and conveyed by the separation roller and further conveying along the conveyance path, and then conveying the recording sheet again toward an image forming position at a prescribed timing;

(d) a detector provided in the conveyance path between the separation roller and the registration roller for detecting the recording sheet;

(e) a recognizing means for recognizing fluctuation of conveyance timing of the recording sheet based on a detection result made by the detector; and (f) a controller for controlling a conveyance of said recording sheet itself when said recording sheet is located between the separation roller and the registration roller based on a recognition result made by the recognizing means.

2. The sheet feeding device of claim 1, wherein the recognizing means detects whether the conveyance timing of the recording sheet is earlier or not with respect to reference timing.

3. The sheet feeding device of claim 2 further comprising an intermediate roller provided at an upstream side of the registration roller, wherein the controller controls a drive of the intermediate roller.

4. The sheet feeding device of claim 3, wherein when the conveyance timing of the recording sheet is recognized by the recognizing means to be earlier, the controller suspends the drive of the intermediate roller temporarily, and then drives again the intermediate roller to feed the recording sheet, while when the conveyance timing of the recording sheet is recognized not to be earlier, the controller continues the drive of the intermediate roller to feed the recording sheet.

5. The sheet feeding device of claim 4, wherein a suspension period of the drive of the intermediate roller is established to a period of time so that the conveyance timing of the recording sheet fed again after the suspension of the drive falls within a range of fluctuation in which the conveyance timing is recognized not to be earlier.

6. The sheet feeding device of claim 4 further comprising a clutch for transmitting and interrupting driving force obtained from a driving source to the intermediate roller, wherein the controller suspends the clutch temporarily thereby suspending the drive of the intermediate roller.

7. The sheet feeding device of claim 2, wherein when the conveyance timing of the recording sheet is recognized not to be earlier with respect to the reference timing, a conveyance speed of the recording sheet at the upstream side of the registration roller is constant.

8. The sheet feeding device of claim 1, wherein the controller controls to convey the recording sheet at a first conveyance speed until the recording sheet reaches a predetermined position at the upstream side of the registration roller, while the controller controls to convey the recording sheet at a second conveyance speed slower than the first conveyance speed until the recording sheet reaches the registration roller from the predetermined position.

9. The sheet feeding device of claim 8, wherein the predetermined position is a position at which the detector is disposed.

10. The sheet feeding device of claim 8, wherein the recognizing means detects whether the conveyance timing of the recording sheet is later or not with respect to reference timing.

11. The sheet feeding device of claim 10 further comprising an intermediate roller at an upstream of the registration roller, wherein the controller controls a driving of the intermediate roller to switch the first conveyance speed over to the second conveyance speed.

12. The sheet feeding device of claim 10, wherein when the conveyance timing that the recording sheet reaches the predetermined position is recognized by the recognizing means to be later with respect to the reference timing, a timing that the controller switches a conveyance speed of the recording sheet from the first conveyance speed over to the second conveyance speed is delayed.

13. An image forming apparatus comprising:

(a) a sheet containing section for containing recording sheets;

(b) a sheet feed roller for feeding a recording sheet from the sheet containing section;

(c) a separation roller for separating and conveying the recording sheet fed by the sheet feed roller;

(d) a conveyance path along which the recording sheet separated and conveyed by the separation roller is conveyed;

(e) a registration roller for stopping temporarily the recording sheet conveyed along the conveyance path, and conveying the recording sheet again toward an image forming position at a prescribed timing;

(f) a detector provided in the conveyance path between the separation roller and the registration roller for detecting the recording sheet;

(g) a recognizing means for recognizing fluctuation of conveyance timing of the recording sheet based on a detection result made by the detector; and (h) a controller for controlling a conveyance of said recording sheet itself when said recording sheet is located between the separation roller and the registration roller based on a recognition result made by the recognizing means.

14. The image forming apparatus of claim 13, wherein the recognizing means detects whether the conveyance timing of the recording sheet is earlier or not with respect to reference timing.

15. The image forming apparatus of claim 14 further comprising an intermediate roller provided at an upstream side of the registration roller, wherein the controller controls a drive of the intermediate roller.

16. The image forming apparatus of claim 15, wherein when the conveyance timing of the recording sheet is recognized by the recognizing means to be earlier, the controller suspends the drive of the intermediate roller temporarily, and then drives again the intermediate roller to feed the recording sheet, while when the conveyance timing of the recording sheet is recognized not to be earlier, the controller continues the drive of the intermediate roller to feed the recording sheet.

17. The image forming apparatus of claim 13, wherein the controller controls to convey the recording sheet at a first conveyance speed until the recording sheet reaches a predetermined position at the upstream side of the registration roller, while the controller controls to convey the recording sheet at a second conveyance speed slower than the first conveyance speed until the recording sheet reaches the registration roller from the predetermined position.

18. The image forming apparatus of claim 17, wherein the recognizing means detects whether the conveyance timing of the recording sheet is later or not with respect to the reference timing.

19. The image forming apparatus of claim 18 further comprising an intermediate roller at an upstream of the registration roller, wherein the controller controls a driving of the intermediate roller to switch the first conveyance speed over to the second conveyance speed.

20. The image forming apparatus of claim 19, wherein when the conveyance timing that the recording sheet reaches the predetermined position is recognized by the recognizing means to be later with respect to the reference timing, a timing that the controller switches a conveyance speed of the recording sheet from the first conveyance speed over to the second conveyance speed is delayed.

* * * * *